US007270105B2

(12) United States Patent
Furuya

(10) Patent No.: US 7,270,105 B2
(45) Date of Patent: Sep. 18, 2007

(54) SLANT ENGINE

(75) Inventor: Akira Furuya, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/348,231

(22) Filed: Feb. 7, 2006

(65) Prior Publication Data

US 2006/0174851 A1 Aug. 10, 2006

(30) Foreign Application Priority Data

Feb. 8, 2005 (JP) ..... 2005-031750

(51) Int. Cl.
*F01M 1/02* (2006.01)

(52) U.S. Cl. ..... 123/196 R; 194/6.2; 194/13.1

(58) Field of Classification Search ..... 123/196 R; 184/6.2, 13.1
See application file for complete search history.

(56) References Cited

U.S. PATENT DOCUMENTS 4,825,825 A * 5/1989 Chino et al. ..... 123/195 HC

FOREIGN PATENT DOCUMENTS

JP 5-50012 U 7/1993
JP 11-081966 3/1999

* cited by examiner

*Primary Examiner*—Noah P. Kamen
(74) *Attorney, Agent, or Firm*—Smith, Gambrell & Russell LLP

(57) ABSTRACT

A slant engine for a utility engine which a cylinder is attached to the crankcase with slanted with respect to the a rotational direction of a crankshaft, comprises a reservoir oil tank formed outside of the crankcase at lower portion for reserving lubricant, a communication pipe connected to bottom portions of the reservoir oil tank and the crankcase for communicating the lubricant in the crankcase and the reservoir oil tank, and a vent pipe connected to both of the reservoir oil tank and the inside of the crankcase.

20 Claims, 5 Drawing Sheets

SLANT ENGINE

CROSS REFERENCE TO RELATED APPLICATIONS

The disclosure of Japanese Application No. 2005-031750 filed on Feb. 8, 2005 including the specification, drawing and abstract is incorporated herein by reference in its entirety.

FIELD OF THE INVENTION

This invention is related to a utility engine used as a power source for a generator etc, preferably a slant engine having a cylinder attached to a crankcase on a slant toward a rotational direction of the crankshaft.

BACKGROUND OF THE INVENTION

In a four-stroke cycle engine, a lubricant as engine oil is stored in a bottom of a crankcase. The lubricant is supplied to appropriate sliding portions that require lubrication, such as a bearing portion of a crankshaft incorporated in the crankcase, a joint portion between the crankshaft and a connecting rod, and a portion between a piston and cylinder bore. In a utility engine used as a power source for a generator or atomizer, the lubricant stored in the bottom of the crankcase is splashed to the sliding portion by a scraper formed on the connecting rod.

On the other hand, a slant engine is used as the power source of the generator etc. As for the slant engine, the cylinder is assembled to the crankcase in such a way that a cylinder bore axis line (a central axis of reciprocation piston) is slanted toward a rotational direction of the crankshaft.

When the slant engine is viewed from a direction along the crankshaft, the cylinder is as assembled to one side of the crankcase. The scraper in the slant engine is assembled at the end portion of the connecting rod so as to splash the lubricant toward an inner surface of the crankcase.

As for such slant engine, if the engine stands on a slope, the stored lubricant stays in one wall side of the crankcase. Thus, when the slant engine is used in the foregoing condition, the scraper may be unable to reach to a liquid surface of the lubricant otherwise it may sink deeply into the lubricant so that it cannot work appropriately for the lubrication in the crankcase.

Japanese Utility Model Laid-Open No. 5-50012 discloses the slant engine comprising partition boards in an oil pan of the crankcase and an oil strainer provided between partition boards so as to prevent accidental entry of air bubbles into the oil strainer by fluctuation of the liquid level.

On the other hand, Japanese Patent Laid-Open No. 11-81966 discloses an engine, but not the slant engine, having an upright cylinder. This engine has an outside reservoir oil tank in addition to the oil pan of the crankcase and a solenoid valve provided in an oil passage connecting the oil pan and the reservoir oil tank for controlling the "open/close" states of the oil passage, so as to increase quantity of lubricant without upsizing the crankcase, It is preferred to increase quantity of lubricant to extend a maintenance period of the lubricant. Where the oil strainer are provided between the partition boards as shown in Japanese Utility Model Laid-Open No 5-50012, it is difficult to increase the quantity of lubricant although the lubricant can be supplied to appropriate portions even if the slant engine stands on a slope.

Furthermore, when the reservoir oil tank is formed outside the crankcase and the solenoid valve controls the passage to the reservoir oil tank depending on a signal from the sensor detecting the level of lubricant surface of the oil pan as shown in Japanese Patent Laid-Open No 11-81966, the structure becomes complicate and the production cost becomes high. Furthermore, it is difficult to apply this structure to the slant engine.

SUMMARY OF THE INVENTION

In view of the above circumstances, the first object of the present invention is to improve lubricating performance when the slant engine is used on a slope or uneven surface. Furthermore, the second object of the invention is to lengthen a maintenance period of engine oil of the slant engine so as to improve maintenance characteristics.

According to the present invention, there is provided a slant engine having a crankcase, a crankshaft rotatably incorporated in the crankcase, a connecting rod, a piston connected to the crankshaft through the connecting rod and a cylinder incorporating the piston inside thereof and attached to the crankcase on a slant, comprising a reservoir oil tank provided outside the crankcase and located under the cylinder for reserving lubricant, a communication pipe connecting a bottom portion of the reservoir oil tank and a bottom portion of the crankcase for the lubricant moving back and forth between the crankcase and the reservoir oil tank, a vent pipe connecting an internal space of the reservoir oil tank and a crank chamber of the crankcase, and a scraper arranged on the connecting rod for splashing the lubricant stored in the crankcase.

It is preferable that the reservoir oil tank comprises a lower portion having a smaller capacity and an upper portion having a larger capacity, said upper portion including a maximum liquid level and minimum liquid level of the stored lubricant for the engine standing at the horizontal-plane.

It is preferable that the vent pipe has an opening to the reservoir oil tank, said opening being closed by the lubricant in the reservoir oil tank in the condition that the engine is inclined in such a way that the position of the reservoir oil tank becomes lower.

It is preferable that the vent pipe has an opening to the reservoir oil tank positioned corresponded to the maximum liquid level of the reservoir oil tank.

It is preferable that the vent pipe is connected to an oil tank cap of the reservoir oil tank.

It is preferable that the reservoir oil tank is formed by a transparent material and has level scale for displaying the maximum liquid level and the minimum liquid level.

It is preferable that the reservoir oil tank has a drain plug at the bottom part of the reservoir oil tank for draining the lubricant oil.

According to the slant engine of the present invention, if the engine stands on a slope or uneven surface in such a way that the reservoir oil tank is positioned lower than the bottom of the crankcase, the liquid level splashed by the scraper tends to rise. However, this invention can prevent an excessive agitating load from being applied to the scraper because the part of lubricant in the crankcase flows into the reservoir oil tank. Furthermore, if the engine is stands on a slope or uneven surface in such a way that the reservoir oil tank is positioned upper than the bottom of the crankcase, the liquid level splashed by the scraper tends to descend. However, this invention enables the scraper to effectively splash the lubricant because the lubricant in the reservoir oil tank flows into the crankcase.

As described above, this invention can improve the lubricant property even in the event that the slant engine stands on a slope or uneven surface. Furthermore, this invention can extend the maintenance period since the large quantity of lubricant is stored in the crankcase and the reservoir oil tank and therefore qualities of the lubricant are kept over the long time. Moreover, because the reservoir oil tank is provided outside the crankcase, the cooling of the lubricant is improved so as to prevent the lubricant from excessively heating up.

Furthermore, since the reservoir oil tank comprises the lower portion having smaller capacity and the upper portion having larger capacity, the maximum and minimum liquid levels of the lubricant can be appropriately adjusted according to the designing of the size of capacity of the lower potion comparing to the size of capacity of the upper portion.

Moreover, the maximum and minimum liquid levels of the lubricant can be appropriately adjusted according to the location of the opening of the vent pipe in the reservoir oil tank and the location of the pipe attaching portion as well as the size of capacity of the lower potion of the reservoir oil tank relative to the size of capacity of the upper portion of the reservoir tank.

DETAILED DESCRIPTION OF THE PREFERRED EMBODIMENTS

A preferred embodiment of the present invention is explained with figures, however, the scope of the invention is not limited by the illustrated embodiments of the figures.

Figure 2:
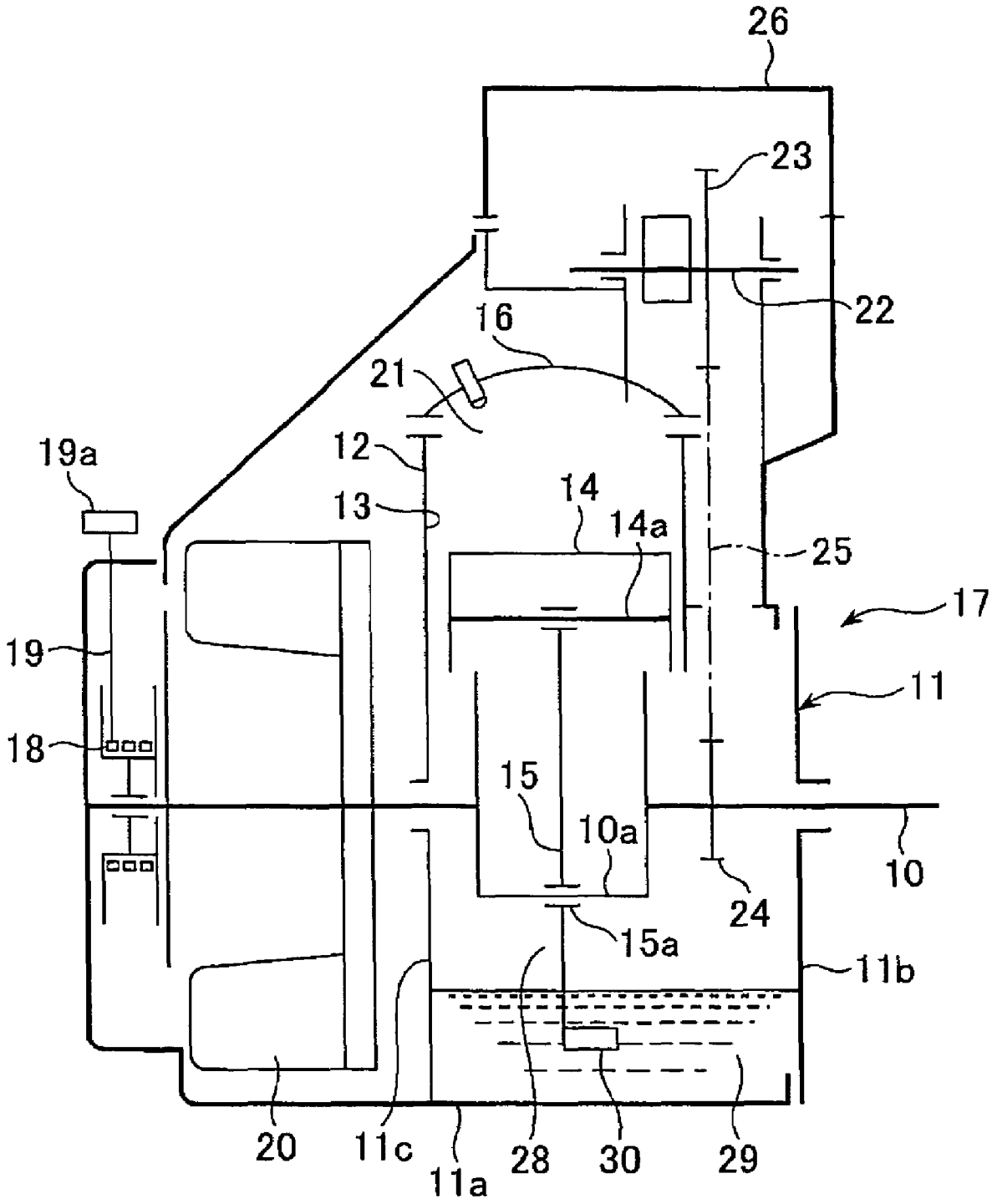
FIG. 2 is an outline view representing internal structure of the slant engine represented by FIG. 1.

A slant utility engine according to the present invention is shown in FIG. 2. This slant engine is a four-stroke cycle one cylinder gasoline engine comprising a cylinder 12, a cylinder head 16 attached to the cylinder 12 and a crankcase 11. A crankshaft 10 is rotatably incorporated in the crankcase 11. The crankcase 11 comprises a main body 11*a* and a case cover 11*b* assembled to the main body 11*a*.

Figure 1:
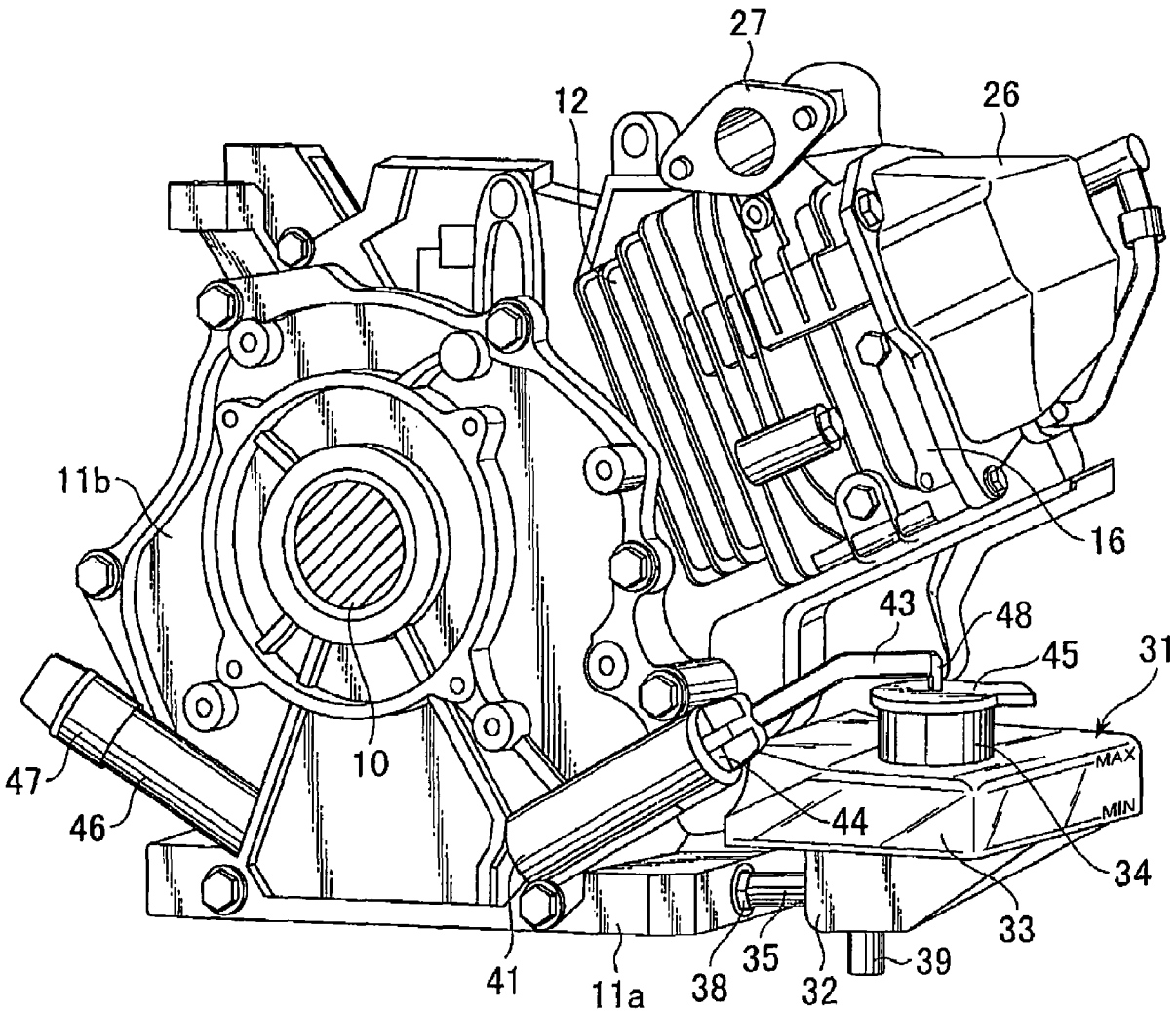
FIG. 1 is a perspective view to show the slant engine according to the present invention.
Figure 3:
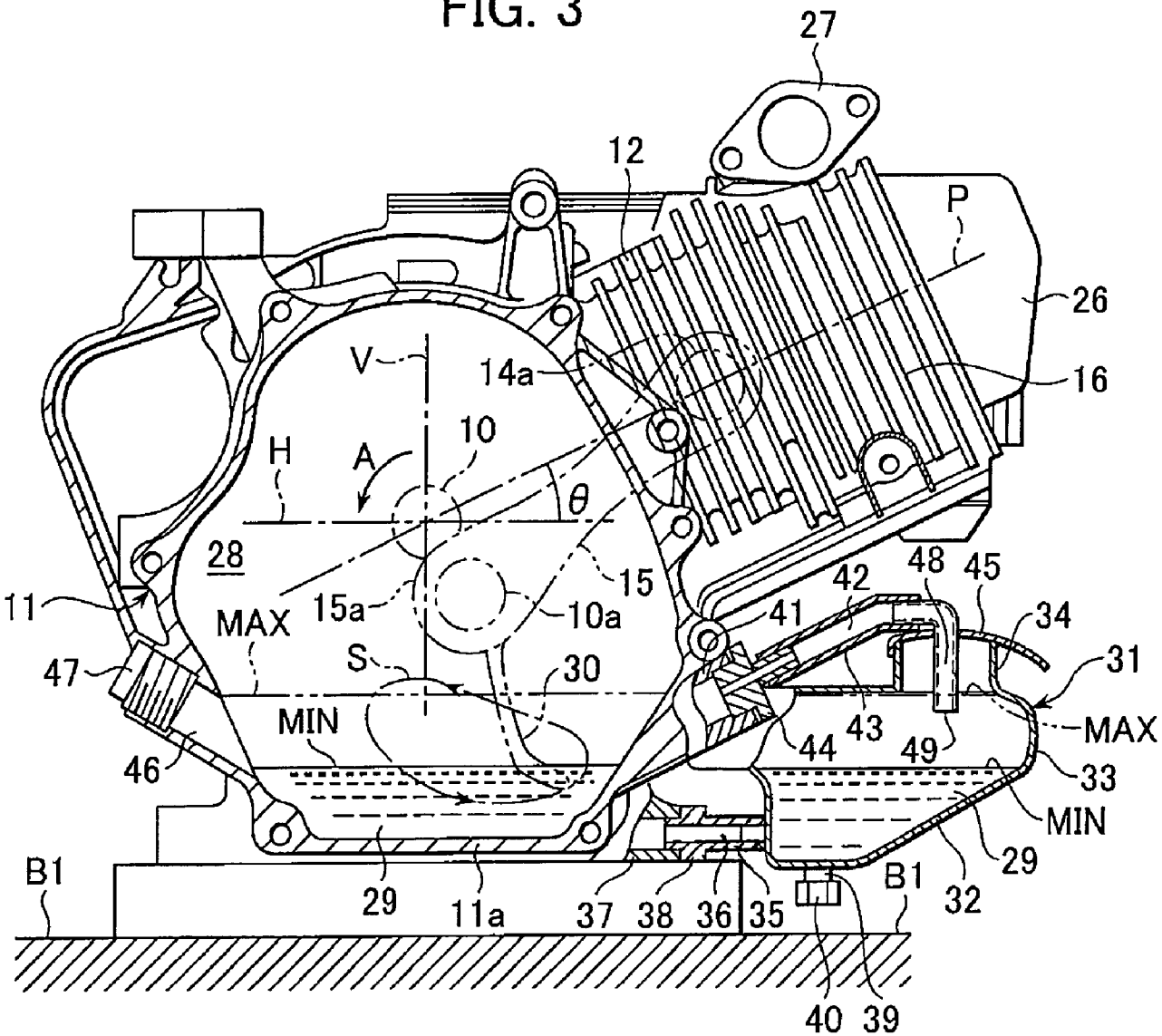
FIG. 3 is a partially cutaway front view of the slant engine standing on a horizontal plane.

FIG. 1 shows the engine in the condition that the case cover 11*b* is assembled to the main body 11*a*. In this figure, the crankshaft 10 is eliminated. FIG. 3 shows the engine in the condition that the case cover 11*b* is removed from the main body 11*a*. The main body 11*a* has a portion in the cylindrical shape with a bottom part, a top part and right and left side walls as shown in FIG. 3. An end wall 11*c* is attached to the main body 11*a* as shown in FIG. 2. The crankshaft 10 is rotatably supported by the end wall 11*c* and the case cover 11*b*.

The cylinder 12 is assembled to the crankcase 11, as shown in FIG. 2. A piston 14 is reciprocally incorporated in a cylinder bore 13 formed in the cylinder 12. The piston 14 is connected to the crankshaft 10 through a connecting rod 15. One end portion of the connecting rod 15 is assembled to a piston pin 14*a* and the other end portion of the connecting rod 15 is assembled to a crank pin 10*a* of the crankshaft 10.

As shown in FIG. 3, the cylinder 12 is assembled to the crankcase 11 in such a way that the cylinder bore axis line P which is a central axis of the piston 14 is slanted at a predetermined angle θ with respect to a case horizontal line H, in the condition that the slant engine stands on a horizontal plane. In the view from a direction along the crankshaft 10, the cylinder 12 is slanted from an upright position toward opposite to a rotational direction A of the crankshaft 10 as shown in FIG. 3.

As shown in FIG. 2, a recoil pulley 18 around which a recoil rope 19 is wound is rotatably attached to the crankshaft 10 to start up the engine. When a recoil knob 19*a* attached to a tip of the recoil rope 19 is operated to pull up the recoil rope 19, the crankshaft 10 is rotationally driven by manual operation, and the engine is started.

When the engine is used for driving the generator, the generator is connected to the crankshaft 10. Furthermore, when the engine is used for driving the atomizer, the shaft of atomizer is connected to the crankshaft 10. In addition, a cooling fan 20 may be applied to the crankshaft to generate cooling air.

In the cylinder head 16, an intake valve is provided for opening and closing an intake port to supply the air mixture into the combustion chamber 21. An exhaust valve is provided for opening and closing an exhaust port to exhaust emission gas from the combustion chamber 21. As shown in FIG. 2, a sprocket wheel 23 is fixed to a camshaft 22 of the engine 17 and a sprocket wheel 24 is fixed to the crankshaft 10. A timing belt 25 is incorporated between the sprocket wheel 24 and the sprocket wheel 23. A valve train system is incorporated in a rocker cover 26 attached to the cylinder head 16. When the crankshaft 10 rotates, the camshaft 22 is rotated in synchronized with the rotation of the crankshaft 10 through the timing belt 25, and the intake and exhaust valves are driven through the valve train system. In addition, an exhaust pipe 27 connected to the exhaust port is shown in FIG. 1 and FIG. 3, and an intake pipe connected to the intake port is hidden behind the engine.

The crankcase 11 has a crank chamber 28 inside and the bottom of the crank chamber 28 forms an oil pan. The lubricant 29 is stored in the oil pan as shown in FIGS. 2 and 3. A scraper 30 is attached to a cap 15*a* of the connecting rod 15, extending toward the oil pan so as to splash the lubricant 29 to lubricate sliding portions in the crankcase 10. In FIG. 3, when the crankshaft 10 rotates in a direction shown as the arrow A, the scraper 30 moves along the movement locus shown as the arrow S. The lubricant 29 is splashed upward by the scraper 30 to the inner surface of the side wall of the crankcase 11 to which the cylinder 12 is attached.

FIG. 3 shows the condition that the engine stands on a horizontal-plane B1 and a vertical line V of the crankcase 11 is perpendicular to a horizontal line H of the crankcase 11. As thus described, the lubricant 29 is stored in the crank chamber 29 unequally on the sides of the cylinder bore axis line P because the cylinder 12 is assembled to the crankcase on a slant. When the crankshaft 10 rotates in the direction shown as the arrow A in FIG. 3, the scraper 30 splashes the lubricant 29 toward the inner surface of the crankcase to which the cylinder is attached. As a result the lubricant 29 is splashed upward by the scraper 30 in a position closed to the cylinder 12.

As shown in FIG. 3, a reservoir oil tank 31 in which the lubricant 29 is reserved is provided outside the crankcase 11 and located on the underside of the cylinder 12. The reservoir oil tank 31 has an upper portion 33 with a larger capacity and a lower portion 32 with a smaller capacity. The reservoir oil tank 31 further has an inlet portion 34 located at the top of the upper portion 33. The reservoir oil tank 31 is formed by transparent or semitransparent synthetic resinous materials. An oil communication pipe 35 is provided to connect between the bottom of the reservoir oil tank 31 and the bottom of the crankcase 11 so that the liquid levels of the lubricant of the reservoir oil tank 31 and the crankcase 11 become the same level. The oil communication pipe 35 has a coupling bolt portion 38 screwed to a pipe attaching portion 37 connected to the bottom of the crankcase 11, whereby the oil communication pipe 35 is detachably connected to the crankcase 11. An oil drain outlet 39 is provided at the bottom of the reservoir oil tank 31 for draining the lubricant 29 and a plug socket 40 is removably attached to the drain outlet 39.

A pipe attaching portion 41 is provided to the crankcase 11 to communicate with the crank chamber 28. In addition, a vent pipe 43 having a vent passageway 42 connecting an upper internal space of the reservoir oil tank 31 and the crank chamber 28 is attached to the pipe attaching portion 41. The vent pipe 43 has a coupling bolt portion 44 screwed to the pipe attaching portion 41 for the detachable connection to the crankcase 11.

As thus described, since the reservoir oil tank 31 is separately provided outside the crankcase 11, cooling efficiency of the reserved lubricant is improved to suppress the rise in lubricant temperature. If the material of the reservoir oil tank 31 is changed to something superior in thermal conductivity such as aluminum alloy, the cooling efficiency is further improved. For more improvement of the cooling efficiency, cooling fins may be provided on an inner surface and/or outer surface of the reservoir oil tank 31.

Since the reservoir oil tank 31 is located in the open space under the cylinder 12, the reservoir oil tank 31 is commonly applied to any slant utility engine without changing the basic structure thereof. In the case of a slant engine without the reservoir oil tank, an oil level gauge may be attached to the pipe attaching portion 41. In addition, the reservoir oil tank 31 may be formed by opaque materials, such as metal, substitute for transparence or semitransparent materials. In the event that any opaque material is used, a semitransparent tube coming out from the reservoir oil tank 31 may be provided for enabling a user to check the liquid level of the lubricant, or the oil level gauge could be inserted in the crankcase 11 by removing the coupling bolt portion 44 so as to check the liquid level of the lubricant directly.

The vent pipe 43 is connected through a projection pipe 48 to an oil tank cap 45 which is attached to the inlet portion 34 to seal the reservoir oil tank 31. The lubricant 29 can be filled in the reservoir oil tank 31 from the inlet portion 34 after removing the oil tank cap 45, the lubricant 29 flows into the crankcase 11 from the reservoir oil tank 31 through a passage 36 in the oil communication pipe 35.

A lubricant inlet 46 is formed in the crankcase 11, and is screwed by a plug 47. In addition, the inlet portion 46 is positioned near the bottom of the engine for draining the lubricant in the reservoir oil tank 31 and the crank chamber 28. At draining the lubricant from the inlet portion 46, the engine is inclined after the plug 47 is removed. In this case, there is no necessity to form the oil drain outlet 39 in the reservoir oil tank 31.

In the case that the slant engine is covered by a noise reduction cover, a maintenance door in the cover is positioned on the side of the cylinder head 16. For this reason, the reservoir oil tank 31 and the oil tank cap 45 can be checked from the outside through the maintenance door opened, and therefore the maintenance operation can be easily conducted.

When the engine is operated in the condition that the surface of lubricant 29 stays between a minimum liquid level represented in continuous line and an absolute maximum liquid level represented in chain double-dashed line in FIG. 3, that is, the liquid level is within the appropriate range, the lubricant is appropriately supplied to the sliding portions in the crankcase 11 by the scraper 30. Since the liquid level of the lubricant 29 in the reservoir oil tank 31 corresponds to the liquid level of the lubricant 29 in the crankcase 11, as shown in FIG. 1, letters "MAX" and "MIN" and reference line marks corresponding to the maximum and minimum liquid levels which are embossed or engraved on the reservoir oil tank 31 indicate the maximum and minimum liquid levels of the lubricant 29 in the crankcase 11, respectively. That is, these indications are used as a display part of the lubricant quantity stored in the crankcase 11. If the lubricant 29 is supplied to the crank chamber 28, the lubricant quantity can be precisely checked by these letters and reference line marks.

An opening portion 49 of the projection pipe 48 opening to the reservoir oil tank 31 approximately corresponds to the position of the absolute maximum liquid level in the reservoir oil tank 31. However, the opening portion 49 may be positioned lower or upper than the illustrated absolute maximum liquid level. In addition, the vent pipe 43 may be directly connected to the oil tank cap 45 without the projection pipe 48 to open into to the reservoir oil tank 31. Furthermore, the vent pipe 43 or projection pipe 48 may be directly assembled to the large quantity portion 33 of the reservoir tank 31.

As shown in FIG. 3, the lubricant 29 supplied in the bottom of the crankcase 11 is stored in approximately equal in the right and left sides with respect to the vertical line V of the crankcase 11 in the condition that the engine stands on horizontal-plane B1. As for the reservoir oil tank 31, since the inside of the reservoir tank 31 is connected to the crankcase 11 through the passage 36 of the oil communication pipe 35, the liquid level of the lubricant 29 in the crankcase 11 corresponds to the liquid level of the lubricant 29 in the reservoir oil tank 31. In FIG. 3, the minimum liquid level is represented in continuous line, and the absolute maximum liquid level is represented in chain double-dashed line.

Figure 4:
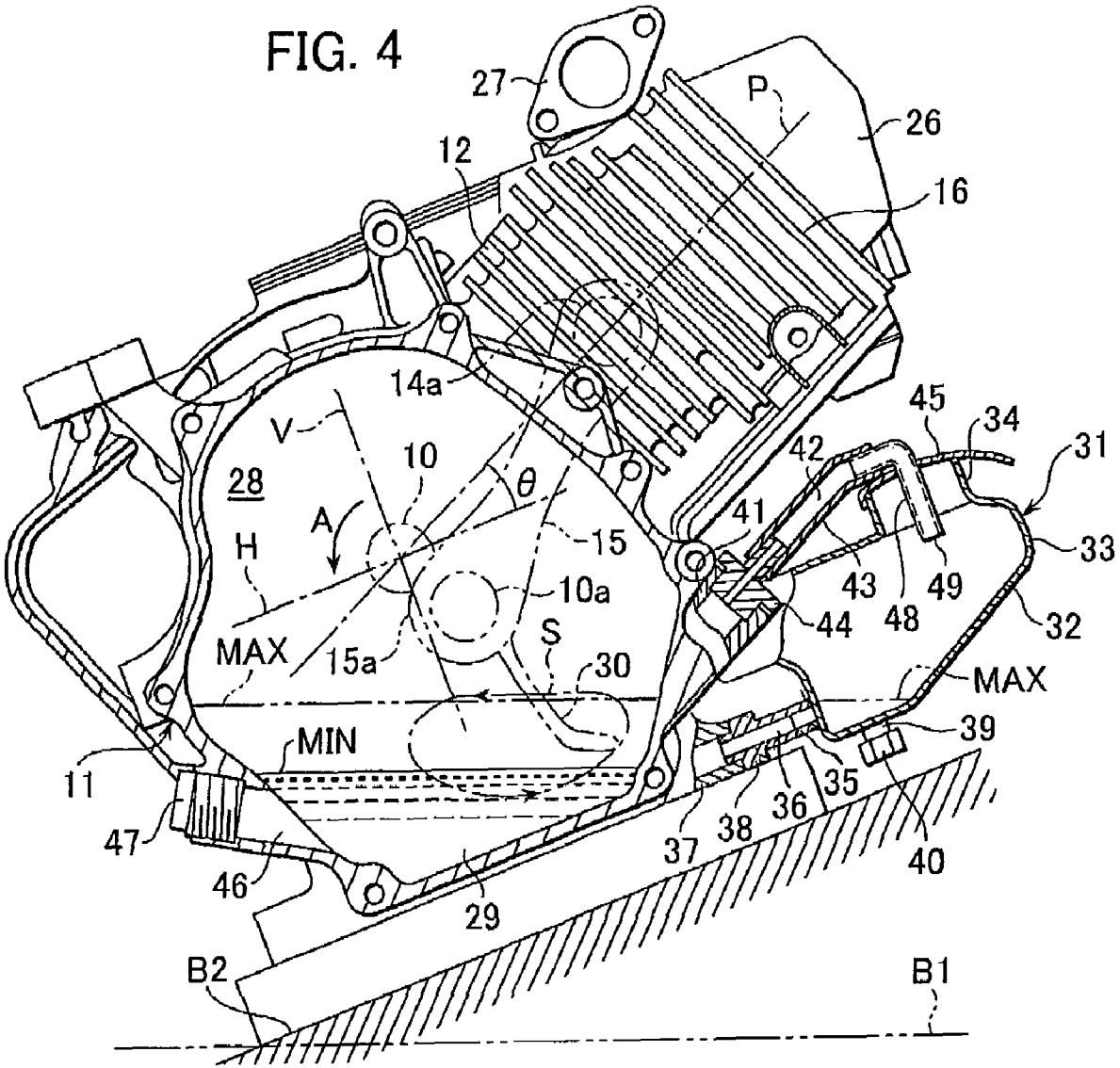
FIG. 4 is a partially cutaway front view representing the slant engine in the condition that the engine stands on a slope in such a way that the reservoir oil tank is positioned upper than a bottom of the crankcase.
Figure 5:
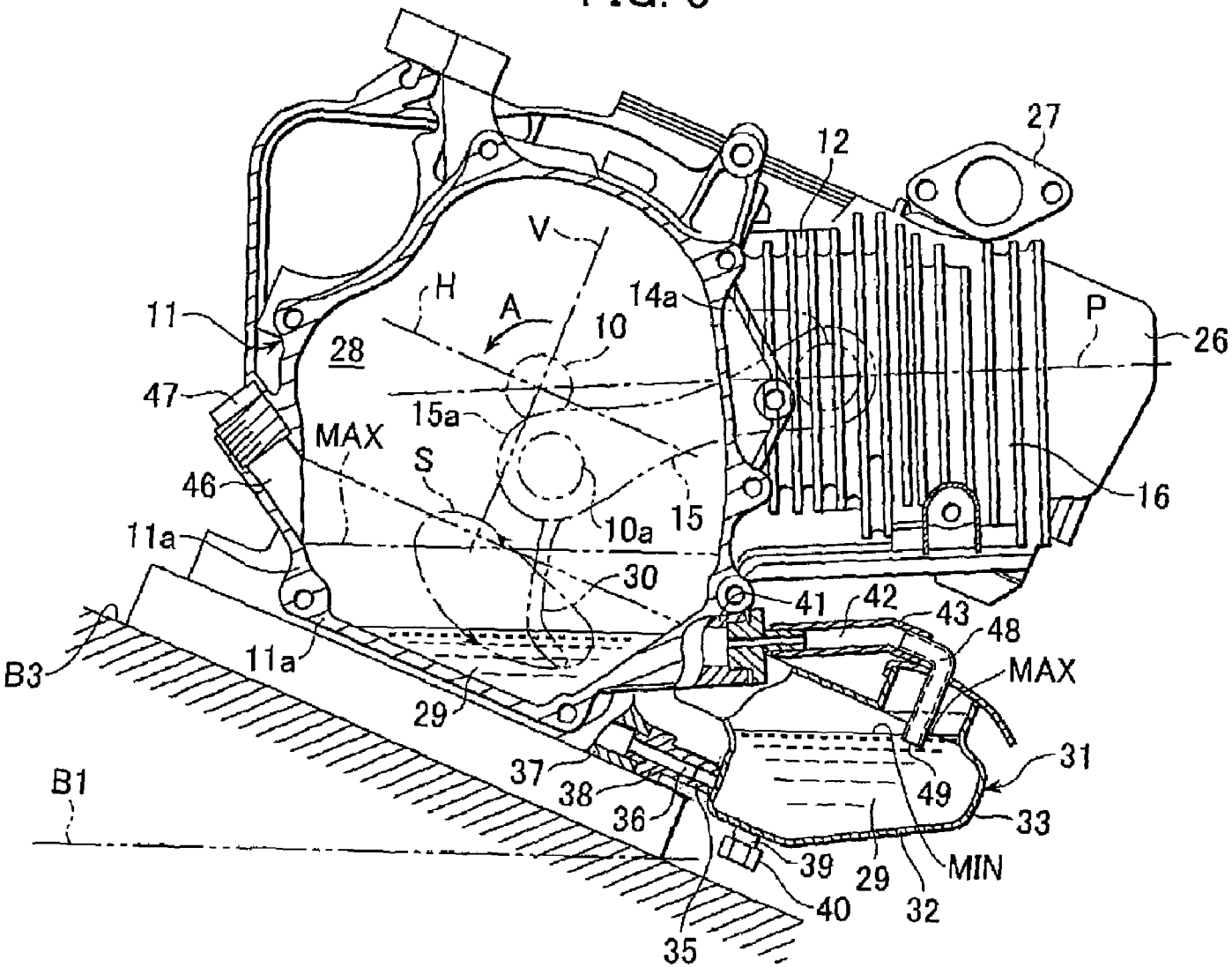
FIG. 5 a partially cutaway front view representing the slant engine in the condition that the engine standing on a slope in such a way that the reservoir oil tank is positioned lower than the bottom of crankcase.

In FIG. 4, the engine stands on the slope or inclined surface B2 so that the reservoir oil tank 31 is positioned on an upper side than the bottom of the crankcase 11. On the other hand, in FIG. 5, the engine stands on the slope or inclined surface B3 so that the reservoir oil tank 31 is positioned on a lower side than the bottom of crankcase 11. In FIGS. 4 and 5, the minimum liquid level of the lubricant 29 is represented by the continuous line, and the absolute maximum liquid level is represented by the chain double-dashed line.

In condition that the reservoir oil tank 31 is positioned on an upper side than the bottom of the crankcase 11 as shown in FIG. 4, the lubricant 29 in the crankcase 11 moves to the left side of the crankcase 11, resulting that liquid level splashed by the scraper 30 tends to lower. However, because the lubricant 29 in the reservoir oil tank 31 moves to the bottom of the crankcase 11 through the communication pipe 35 by its own weight, the liquid level of the lubricant 29 in the crankcase 11 remains to enable the scraper 30 to well splash the lubricant 29. FIG. 4 represents the condition that the lubricant 29 in the reservoir oil tank 31 flowed into the crankcase 11 entirely while the quantity of the lubricant 29 is at the minimum liquid level. Thus, when the scraper 30 follows the movement locus S with the rotation of the crankshaft 10, the scraper 30 sinks in lubricant 29 and splashes the lubricant 29 upward to supply the lubricant 29 to the portions that requires lubrication.

As shown by the chain double-dashed line in FIG. 4, even in the event that the lubricant 29 in the reservoir oil tank 31 flows into the crankcase 11 while the liquid level in the crankcase 11 is at the maximum liquid level, the increase of the load resistance applied to the crankshaft 10 through the scraper 30 can be prevented. This is because a quantity of the lubricant 29 in the crankcase 11 is shifted toward the space opposite to the cylinder 12 with respect to the crankshaft 10, resulting in that the liquid level around the movement locus S of the scraper 30 does not rise excessively.

As thus described above, to enable the scraper 30 to efficiently splash the lubricant 29 upward even in the event that the engine stands on the slope or inclined surface as shown in FIG. 4, the maximum and minimum liquid levels of the lubricant 29 can be appropriately adjusted depending upon the size of capacity of the lower potion 32 comparing to the size of capacity of the upper portion 33.

On the other hand, as shown in FIG. 5 the lubricant 29 in the crankcase 11 flows into the reservoir oil tank 31 through the oil communication pipe 35 in the condition that the engine stands on the slope or inclined surface so that the reservoir oil tank 31 is positioned on a lower side than the bottom of the crankcase 11. In this case, the liquid level of the lubricant 29 around the movement locus S of the scraper 30 tends to rise. However, because the lubricant 29 in the crankcase 11 flows into the reservoir oil tank 31, liquid level of the lubricant 29 in the crankcase 11 remains to enable the scraper 30 to splash the lubricant 29 without applying the excessive load to the scraper 30.

When the lubricant 29 in the crankcase 11 flows into the reservoir oil tank 31, the liquid level of the lubricant 29 of the reservoir oil tank rises, resulting in that the lubricant 29 closes the opening portion 49. At the same time, the pipe attaching portion 41 is covered by the lubricant 29 in the crankcase 11 since the engine is inclined. Accordingly, both ends of the vent passageway 42 are closed by the lubricant 29 so that air is sealed inside thereof and the lubricant 29 in the crankcase 11 is prevented from flowing into the reservoir oil tank 31. As a result, the excessive lubricant 29 is prevented from flowing into the reservoir oil tank 31, and therefore the liquid level of lubricant 29 in the crankcase 11 is prevented from excessively descending so that the required amount of the lubricant 29 remains in the crankcase 11. When the scraper 30 moves along the movement locus S shown in FIG. 5 with the rotation of the crankshaft 10, the scraper 30 effectively splashes the lubricant 29 upward, and the lubricant 29 is supplied to the portions that require lubrication.

As thus described above, to enable the scraper 30 to efficiently splash the lubricant 29 upward even in the event that the engine stands on the slope or inclined surface as shown in FIG. 5, the maximum and minimum liquid levels of the lubricant 29 can be appropriately adjusted depending upon the location of the opening portion 49 in the reservoir oil tank 31 and the location of the pipe attaching portion 41 as well as the size of capacity of the lower potion 32 relative to the size of capacity of the upper portion 33.

The present invention is not limited by detailed description of the disclosed embodiment. It can be changed in the range which does not deviate from the gist in various ways. For example, although the slant engine to illustrate is one cylinder, the present invention, however, can be applied to the engine with a plurality of cylinders.

What is claimed is:

1. A slant engine having a crankcase, a crankshaft rotatably incorporated in the crankcase, a connecting rod, a piston connected to the crankshaft through the connecting rod and a cylinder incorporating the piston inside thereof and attached to the crankcase on a slant, comprising:

a reservoir oil tank provided outside the crankcase and located under the cylinder for reserving lubricant;

a communication pipe connecting a bottom portion of the reservoir oil tank and a bottom portion of the crankcase for the lubricant moving back and forth between the crankcase and the reservoir oil tank;

a vent pipe connecting an internal space of the reservoir oil tank and a crank chamber of the crankcase; and a scraper arranged on the connecting rod for splashing the lubricant stored in the crankcase.

2. The slant engine according to claim 1, wherein the reservoir oil tank comprises a lower portion having a smaller capacity and an upper portion having a larger capacity, said upper portion including a maximum liquid level and minimum liquid level of the stored lubricant for the engine standing at the horizontal-plane.

3. The slant engine according to claim 2, wherein the reservoir oil tank is formed by a transparent material and has level scale for displaying the maximum liquid level and the minimum liquid level.

4. The slant engine according to claim 1, wherein the vent pipe has an opening to the reservoir oil tank, said opening being closed by the lubricant in the reservoir oil tank in the condition that the engine is inclined in such a way that the position of the reservoir oil tank becomes lower.

5. The slant engine according to claim 1, wherein the vent pipe has an opening to the reservoir oil tank positioned corresponded to the maximum liquid level of the reservoir oil tank.

6. The slant engine according to claim 1, wherein the vent pipe is connected to an oil tank cap of the reservoir oil tank.

7. The slant engine according to claim 1, wherein the reservoir oil tank has a drain plug at the bottom part of the reservoir oil tank for draining the lubricant oil.

8. The slant engine according to claim 1, wherein the reservoir oil tank comprises a lower portion having a smaller capacity and an upper portion having a larger capacity.

9. A slant engine having a cylinder attached to the crankcase on a slant, comprising:

a reservoir oil tank provided outside the crankcase;

a communication pipe connecting a bottom portion of the reservoir oil tank and a bottom portion of the crankcase for the lubricant moving back and forth between the crankcase and the reservoir oil tank; and a vent pipe connecting an internal space of the reservoir oil tank and an internal space of the crankcase, wherein the vent pipe has an opening to the reservoir oil tank, said opening being closed by the lubricant in the reservoir oil tank in the condition that the engine is inclined in such a way that the position of the reservoir oil tank becomes lower.

10. The slant engine according to claim 9, further comprising a scraper arranged on the connecting rod for splashing the lubricant stored in the crankcase.

11. The slant engine according to claim 10, wherein the scraper sinks in the lubricant when the opening to the reservoir oil tank is closed by the lubricant in the reservoir oil tank.

12. The slant engine according to claim 11, wherein the reservoir oil tank is formed by a transparent material and has level scale for displaying a maximum liquid level and a minimum liquid level.

13. The slant engine according to claim 9, wherein the reservoir oil tank comprises a lower portion having a smaller capacity and an upper portion having a larger capacity, said upper portion including a maximum liquid level and minimum liquid level of the stored lubricant for the engine standing at the horizontal-plane.

14. The slant engine according to claim 9, wherein the vent pipe has an opening to the reservoir oil tank positioned corresponded to the maximum liquid level of the reservoir oil tank.

15. The slant engine according to claim 9, wherein the vent pipe is connected to an oil tank cap of the reservoir oil tank.

16. The slant engine according to claim 9, wherein the reservoir oil tank has a drain plug at the bottom part of the reservoir oil tank for draining the lubricant oil.

17. The slant engine according to claim 9, wherein said reservoir oil tank and cylinder are located on a common side of the crankcase.

18. The slant engine according to claim 9, wherein the reservoir oil tank is located under the cylinder for reserving lubricant.

19. The slant engine according to claim 9, wherein the reservoir oil tank comprises a lower portion having a smaller capacity and an upper portion having a larger capacity.

20. The slant engine according to claim 9, wherein, when the engine is inclined in such a way that the position of the reservoir oil tank becomes lower, opposite ends of said vent pipe are closed by the lubricant contained, respectively, in the crankcase and in the reservoir oil tank such that air is sealed inside said vent pipe and the lubricant in the crankcase is prevented from flowing into the reservoir oil tank.

* * * * *